US011596191B1

(12) United States Patent
Fazal

(10) Patent No.: US 11,596,191 B1
(45) Date of Patent: Mar. 7, 2023

(54) SEAMLESS THREADING METHOD OF INSERTING HAIR EXTENSIONS

(71) Applicant: Leda Fazal, Raleigh, NC (US)

(72) Inventor: Leda Fazal, Raleigh, NC (US)

( * ) Notice: Subject to any disclaimer, the term of this patent is extended or adjusted under 35 U.S.C. 154(b) by 0 days.

(21) Appl. No.: 17/750,901

(22) Filed: May 23, 2022

(51) Int. Cl.
*A41G 5/00* (2006.01)

(52) U.S. Cl.
CPC ..... *A41G 5/006* (2013.01); *A41G 5/0073* (2013.01)

(58) Field of Classification Search
CPC ..... A41G 5/00; A41G 5/004; A41G 5/0046; A41G 5/0053; A41G 5/0066; A41G 5/0086; A41G 5/0073
See application file for complete search history.

(56) References Cited

U.S. PATENT DOCUMENTS 5,121,761 A * 6/1992 Meister ..... A41G 5/0053 132/201
8,336,559 B2 12/2012 Kallabat et al.
9,491,978 B2 11/2016 Kim
2007/0125399 A1* 6/2007 Guliker ..... A41G 5/0066 132/201
2008/0236605 A1 10/2008 Russo
2014/0060566 A1* 3/2014 Walker ..... A41G 5/0073 132/201
2019/0357614 A1* 11/2019 Rangel ..... A41G 5/0086
2020/0113262 A1* 4/2020 Tokko ..... A41G 5/0086
2020/0260810 A1 8/2020 Tokko
2021/0059337 A1 3/2021 Turley
2021/0169165 A1 6/2021 Hsu
2021/0227910 A1 7/2021 Sawyer
2021/0235801 A1 8/2021 Smith

* cited by examiner

*Primary Examiner* — Rachel R Steitz
(74) *Attorney, Agent, or Firm* — Ashley D. Johnson; Dogwood Patent and Trademark Law

(57) ABSTRACT

The invention is directed to a seamless threading method of inserting hair extensions in a user's hair. The method includes sectioning and beading a user's natural hair. A bottom hair extension weft is then positioned under the beaded sections of hair. The beaded hair is then laid on top of the bottom weft and clipped to secure the bottom weft in place. A top hair extension weft is positioned above the bottom weft in a reversed orientation, with the beaded hair in between the two wefts. Next, a user sews through the top weft, bottom weft, and optionally the beads. The threading begins on a first side of the upper and lower weft strips, extends across the wefts to the second side of the wefts. The threading can then be reversed and sewn back to the first side using a single portion of thread. The upper weft can then be inverted, and the upper weft hair flipped back and smoothed down. Advantageously, the thread is seamless without being visible because the weft strips are sewn from the inside out.

20 Claims, 10 Drawing Sheets

SEAMLESS THREADING METHOD OF INSERTING HAIR EXTENSIONS

TECHNICAL FIELD

The presently disclosed subject matter is generally directed to a system and method of inserting and securing hair extensions comprising a seamless thread installation.

BACKGROUND

Hair extensions have been used for thousands of years to give volume and beauty to a user's hair. For example, many people wear hair extensions to add density to thinner hair. Additionally, hair extensions allow a user to continually change their hair color and length without having to grow, cut, and/or dye their hair. Typically, hair extensions include loose hair strands that are not attached to one another. Application of the individual strands into a user's hair is very time consuming and requires high levels of skill. Accordingly, hair weft extensions are much more common. Hair weft extensions include a plurality of hairs that are gathered together along a common edge or band. Typically, a weft hair extension provides strands of real or artificial hair that are sewn together by machine to create a tracking effect with a polyurethane strip sewn on after the hairs are joined. Conventionally, to apply weft hair extensions, the user's natural scalp hair is separated into sections, and the weft hair extension is then clipped to the scalp hair. Next, a small section of scalp hair and a small section of the weft hair are joined. A small bead that matches hair color is slipped on and crimped into place to combine the scalp hair and the weft hair strands. However, attachment of the weft in this manner frequently creates lumps or bulges in hair, rendering the attachment of the weft highly visible. In addition, the thread used to sew the wefts are unsightly. It would therefore be beneficial to provide an improved system and methods of installing hair extensions to achieve a natural look to the user's hair by using a seamless threading technique.

SUMMARY

In some embodiments, the presently disclosed subject matter is directed to a seamless threading method of attaching weft hair extensions to the natural hair of a user. Specifically, the method comprises sectioning a bottom row from a top row via a seam in the natural hair of a user, wherein the seam is a desired location of attaching a hair extension. The method includes creating a plurality of dropout sections between the bottom row and top row. The method further includes inserting each dropout section into a central channel of a corresponding bead to create a plurality of beaded drop out sections. The method includes positioning a bottom weft hair extension below the seam and above the beaded dropout sections, wherein the bottom weft hair extension comprises a top strip and a plurality of hairs attached to the strip. The method includes positioning a top weft hair extension above the seam and above the bottom weft in an inverted orientation, wherein the top weft hair extension comprises a top strip and a plurality of hairs attached to the strip, wherein the bottom weft strip and the top weft strips are aligned and parallel with each other, and the beaded drop out sections are positioned between the bottom weft and the top weft. The method includes sewing the strips of the bottom weft and top weft together with a needle and thread, whereby the needle and thread can pass through a portion of each bead, wherein the wefts are sewn from a first edge to a second edge and back to a first edge of the wefts. The method can include clamping each bead to deform the bead and maintain it in position, wherein the beads and thread are secured between the top weft and bottom weft. The method includes inverting the top weft by positioning the top weft hair to overlay the bottom weft hair, wherein the bottom weft and top weft blend with the user's natural hair. Importantly, the sewing of the wefts is seamless because the weft strips are parallel when sewn and the top weft is then inverted after sewing. The thread used to sew together the top and bottom wefts is seamless, being hidden from view by the top weft strip and hair when the top weft is inverted to the use orientation (e.g., with the weft strip positioned above the weft hair).

In some embodiments, the method includes repeating the method for a desired number of hair locations.

In some embodiments, the seam is horizontal or vertical.

In some embodiments, the seam is U-shaped, or V-shaped.

In some embodiments, each bead is selected from a clip, deformable cylinder, ring, or combinations thereof.

In some embodiments, each bead central channel comprises a silicone surface.

In some embodiments, each dropout section has a width of about 0.1-1 inch.

In some embodiments, the natural hair is damp or wet.

In some embodiments, the hair is selected from human hair, animal hair, artificial hair, or combinations thereof.

In some embodiments, the strip includes a plurality of guide holes sized and shaped for a needle to pass therethrough.

In some embodiments, the needle is a curved needle.

In some embodiments, the method includes beading about 5-20 beaded drop out sections.

In some embodiments, positioning a top weft hair in an inverted orientation comprises positioning the top weft hair in an inverted direction that does not overlay with the hair of the bottom weft.

In some embodiments, positioning a top weft hair in an inverted orientation comprises positioning the top weft hair to upwards over a top of the user's head.

In some embodiments, the method includes adding another row of stitching to the top weft strip and bottom weft strips after inverting the top weft.

In some embodiments, a single portion of thread is used in the disclosed method.

In some embodiments, the thread comprises about 100 weight percent polyester.

In some embodiments, the thread has a diameter of about 0.1 mm or 0.2 mm or less.

In some embodiments, the thread strength is 1000 denier. "Thread strength" refers to the amount of force/weight applied to break the thread.

In some embodiments, the thread has a strength break of at least about 5 pounds or more.

DETAILED DESCRIPTION

Figure 1:
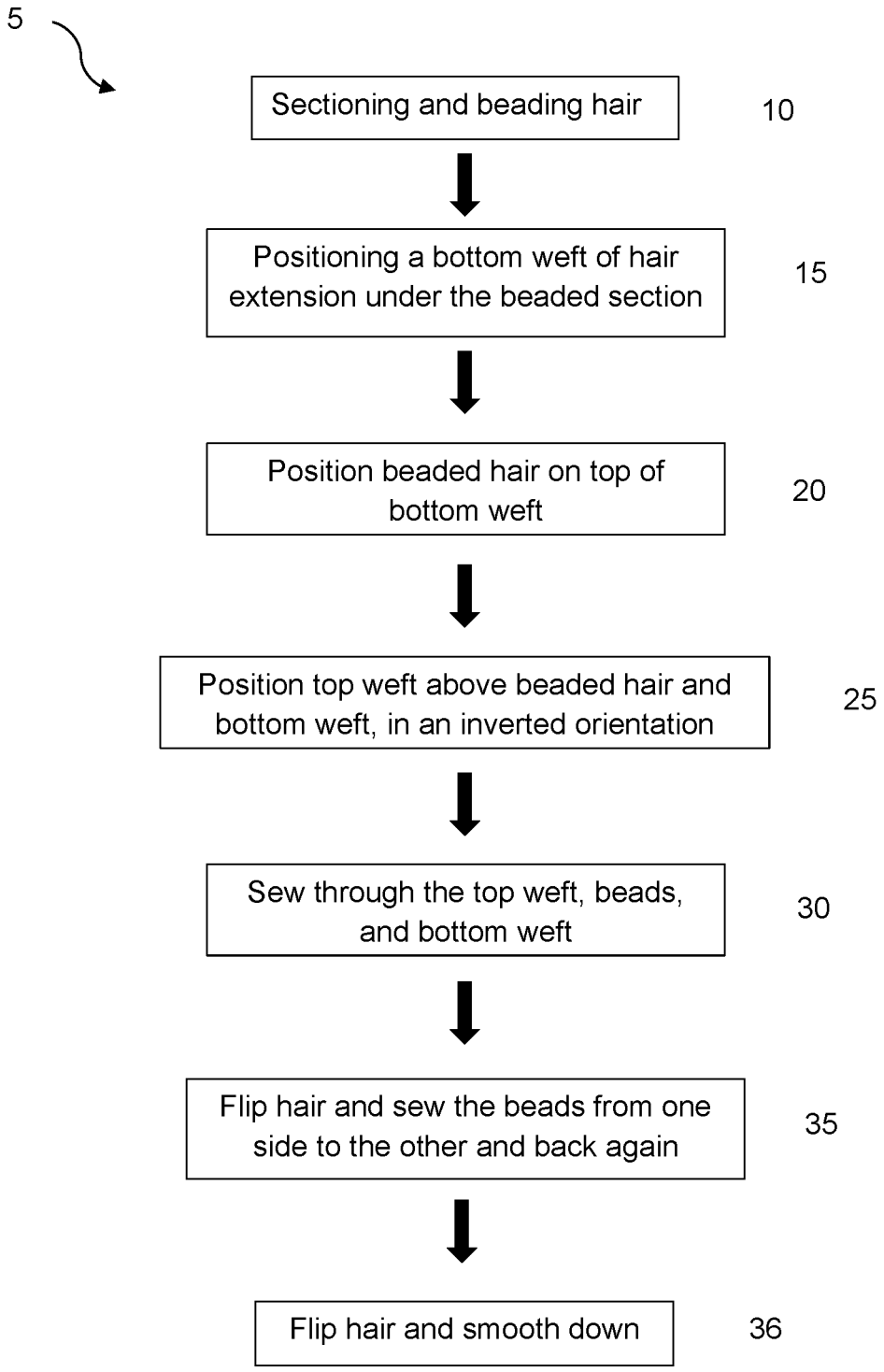
FIG. 1 is a schematic illustrating one method of securing hair extension wefts in a user in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a method of inserting hair extensions in a user's hair using a seamless thread installation technique. As set forth in the schematic of FIG. 1, method 5 includes sectioning and beading a user's natural hair at step 10. A bottom hair extension weft is then positioned under the beaded sections of hair at step 15. The beaded hair is then laid on top of the bottom weft and clipped to secure the bottom weft in place at step 20. A top hair extension weft is positioned above the bottom weft, with the beaded hair in between the two wefts at step 25. Importantly, the top weft is in an inverted configuration, such that the seams between the two wefts are parallel. At step 30, a user sews through the top weft, bottom weft, and the beads. The stylist can sew a first side to a second side, reverse, and sew back to the first side at step 35. The hair can then be flipped back and smoothed down at step 40. Advantageously, the thread is seamless on the top and bottom, and the beads and thread are secured in between the top and bottom wefts without being visible. This method is referred to as "the Swan Method."

It should be understood that the steps of any disclosed methods are not limited to being carried out in any particular sequence. Indeed, the steps of the disclosed methods generally can be carried out in various sequences and arrangements while still falling within the scope of the present invention.

Figure 2A:
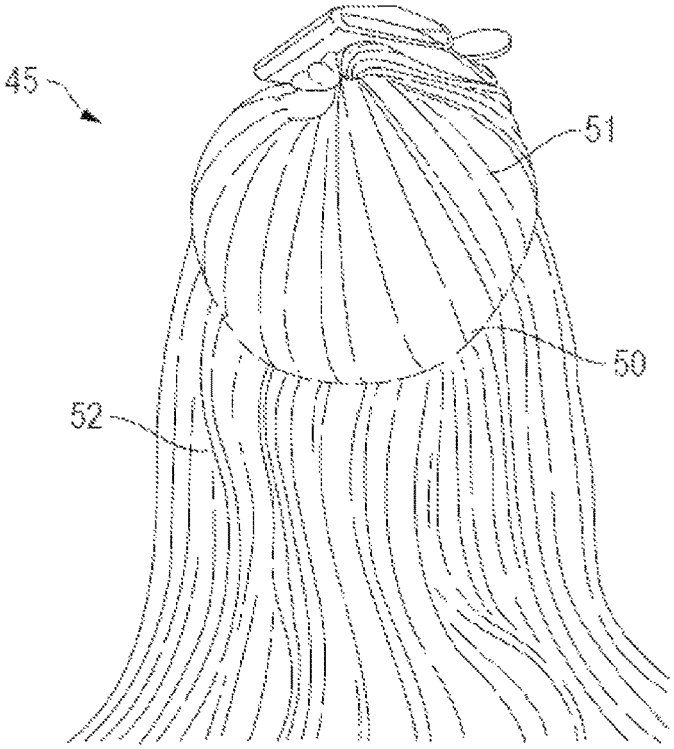
FIG. 2*a* is a front view of sectioned hair comprising a seam in accordance with some embodiments of the presently disclosed subject matter.
Figure 2B:
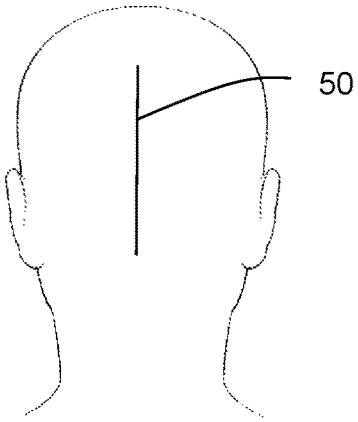
FIGS. 2*b*-2*d* are front plan views of a vertical seam, a horizontal seam, and a u-shaped seam in accordance with some embodiments of the presently disclosed subject matter.
Figure 2C:
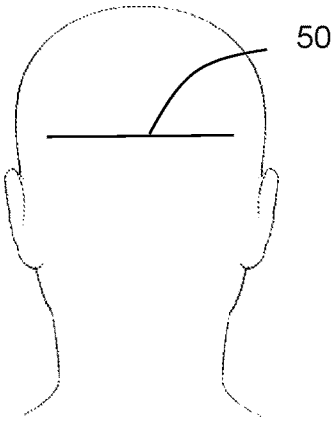
Figure 2D:
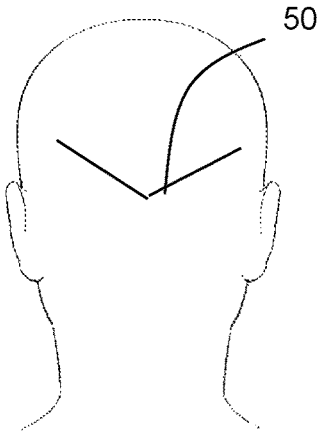

As set forth above, the method includes first step 10 of sectioning and beading the natural hair 45 of a user. The term "natural hair" refers to existing hair that grows naturally from the scalp of the user. Sectioning allows a hairdresser to properly place the hair extension in a desired location. During sectioning, natural scalp hair 45 is separated by seam 50 into at least two sections (51 and 52) as shown in FIG. 2*a*. Scalp hair 45 can be separated at the back of the head, the sides, and/or the front. Thus, any section of the head can receive the weft hair extension, and the seam can be U-shaped, vertical, horizontal, V-shaped, and the like, as shown in FIGS. 2*b*-2*d*. The seam is the proximate location where the hair extension wefts will be applied.

Figure 2E:
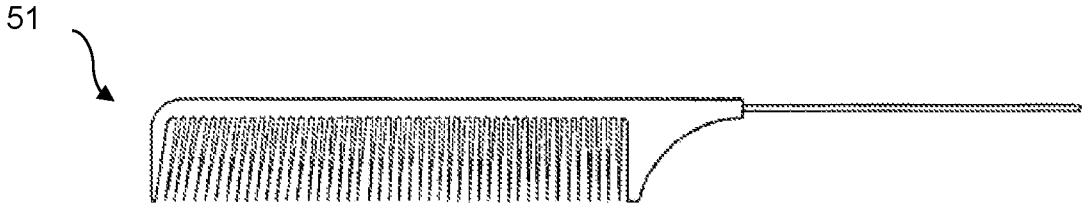
FIG. 2*e* is a front plan view of a sectioning tool in accordance with some embodiments of the presently disclosed subject matter.

Any element can be used to section hair 45 and create seam 50, such as (but not limited to) a comb or other parting tool. One example of tool 51 is shown by a comb in FIG. 2*e*.

Figure 2F:
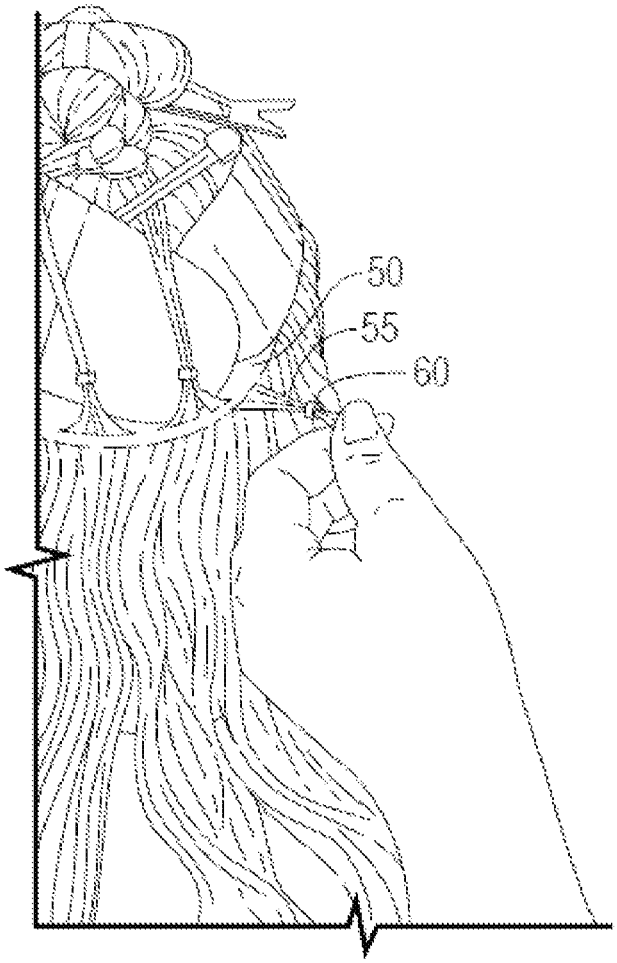
FIG. 2*f* is a front view of beading hair in accordance with some embodiments of the presently disclosed subject matter.
Figure 2G:
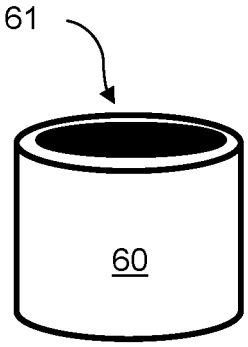
FIG. 2*g* is a perspective view of a bead in accordance with some embodiments of the presently disclosed subject matter.

After the natural hair has been sectioned and seam 50 formed, the user's hair can then be beaded adjacent to the seam, as shown in FIG. 2*f*. During beading, section 55 of natural hair ("dropout section") is passed through an opening in bead 60 below or above seam 50. The term "bead" includes any device that is able to secure two bundles of hair together, such as clips, deformable cylinders, deformable beads, rings, etc. FIG. 2*g* illustrates one embodiment of bead 60 comprising opening 61 that passes through the bead body. The opening creates a passageway for a dropout section of natural hair to pass through.

When placing beads 60, hair 45 should be at a natural fall position which keeps the user's hair healthier with less pulling. After the bead dropout section is measured and bead 60 inserted onto the section of hair using a loop or threader as mentioned above, the bead can be placed a short distance from the user's scalp. If the bead is positioned directly on the user's scalp, it can become uncomfortable and pulls the natural hair.

Figure 2H:
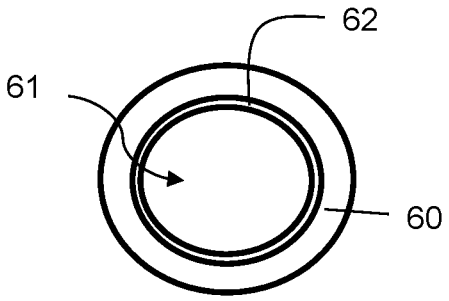
FIG. 2*h* is a top plan view of a bead comprising interior cushioning in accordance with some embodiments of the presently disclosed subject matter.

Beads 60 can be constructed from any suitable material, such as (but not limited to) metal, plastic, and the like. In some embodiments, bead opening 61 can be lined with silicone or other protective cushioning 62, designed to be gentle on the user's natural hair, as shown in FIG. 2*h*.

Beads 60 can be of any suitable size, such as about 1-10 mm (e.g., at least/no more than about 1, 2, 3, 4, 5, 6, 7, 8, 9, or 10 mm in diameter).

Any suitable tool can be used to insert the user's hair through bead 60. For example, a looped or hooked tool can be used to pull a segment of natural hair through a corresponding bead. Each section of hair that is pulled through bead 60 is termed a "dropout section." Each dropout section can be of about 0.2-1 inches wide (e.g., at least/no more than about 0.2, 0.3, 0.4, 0.5, 0.6, 0.7, 0.8, 0.9, or 1 inches). However, the presently disclosed subject matter is not limited and dropout sections greater or less than the given range can be used. For example, when a user's natural hair is thin and fine, fewer beads may be required and/or the beads may be placed closer together. Thus, the beads can be placed directly adjacent to each other or spaced apart. In addition, fewer or greater number of beads can be positioned in the user's hair depending on hair type and the look desired.

In some embodiments, the user's hair is wet or damp when beaded, which allows the stylist more control when inserting a section of hair through bead opening 61 (e.g., fewer fly aways or loose hairs). Wet or damp hair can also be easier to manage.

Figure 2I:
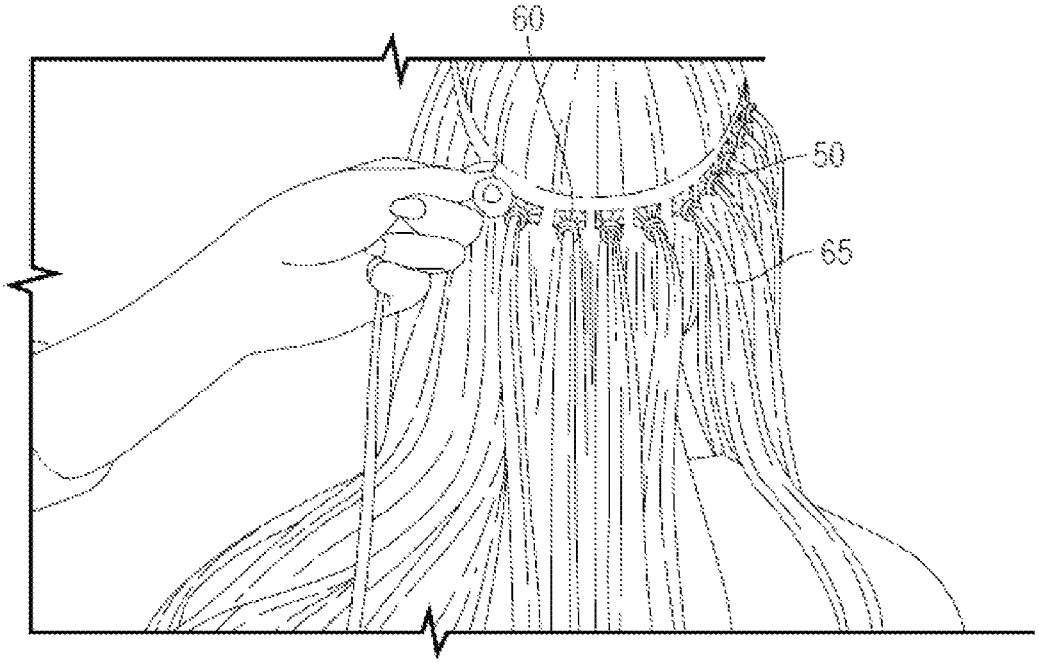
FIG. 2*i* is a front view of beading hair into dropout sections in accordance with some embodiments of the presently disclosed subject matter.

The process can then be repeated for adjacent dropout sections 65 and beads, as shown in FIG. 2*i*. Each bead should be closely spaced to adjacent beads (e.g., less than 1 inch apart). For example, a linear separation between beads of about 0.1-1 inch can be used. In some embodiments, the beads are directly adjacent to each other. In other embodiments, the beads are spaced apart. The proximity between beads increases the fastening security of the hair wefts, as described below. Once all of the beads 60 are placed along the seam, a beaded track is thereby created.

Figure 3A:
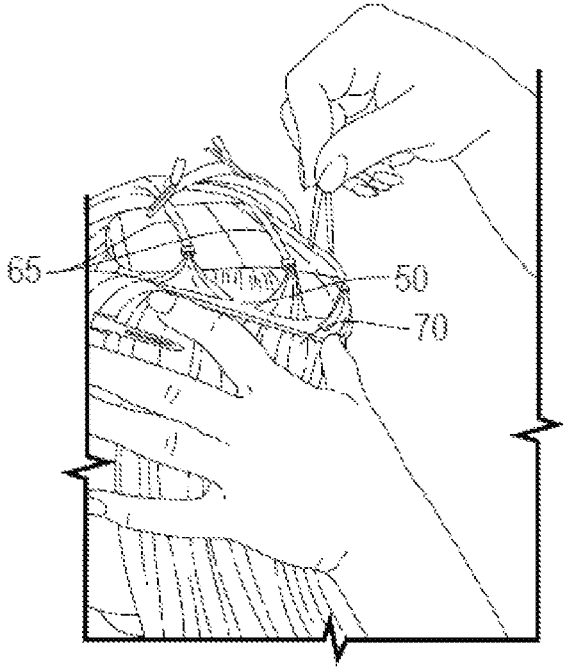
FIG. 3*a* is a front view illustrating positioning a bottom weft below a sectioned seam in accordance with some embodiments of the presently disclosed subject matter.
Figure 3B:
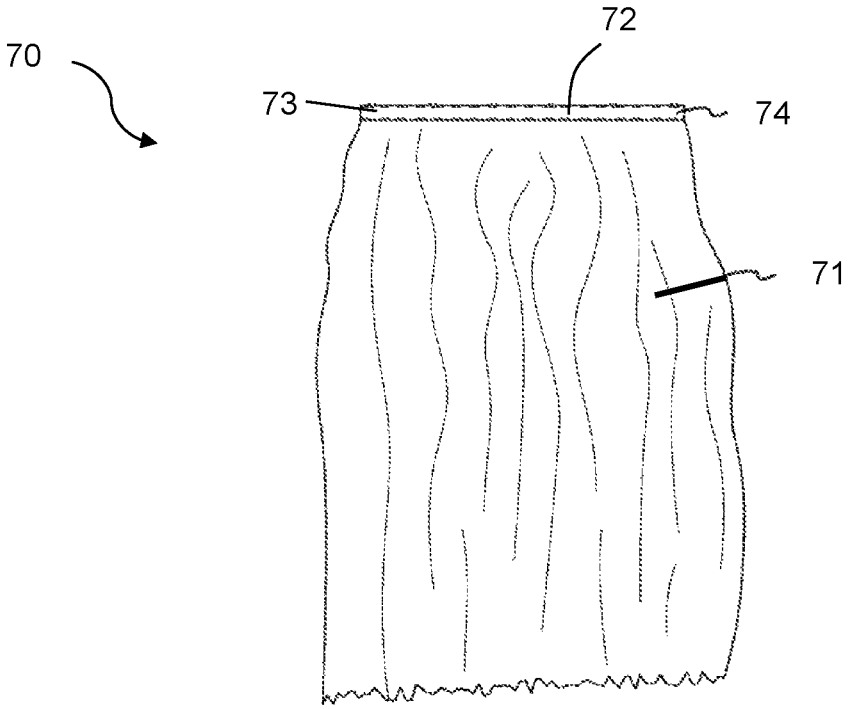
FIG. 3*b* is a front plan view of a hair weft in accordance with some embodiments of the presently disclosed subject matter.

FIG. 3*a* illustrates step 15 of the disclosed method, comprising positioning bottom weft of hair 70 under the beaded dropout sections 65. In some embodiments, the beaded dropout sections can be clipped above seam 50 to keep them out of the way. The term "weft" refers to a weft of hair extensions, as illustrated in FIG. 3*b*. As shown, weft 70 includes a plurality of strands of extension hair 71 dispersed evenly and bound about common strip 72 that keeps the hair in place. Each strip includes first and second edges 73, 74. The hair can be hand tied, machine tied, and/or adhesively applied into strip 72 to permanently affix hair 71 to the weft. Any type of hair can be used, such as synthetic hair, plastic hair, human hair, animal hair, or combinations thereof.

Strip 72 is typically made from flexible, resilient, skin-like material and is easily blended in the scalp of the user. In some embodiments, strip 72 can be a polyurethane, lace, or plastic strip that includes mesh, allowing for hair 71 to be easily attached. Once the hair is attached to the strip, a dangling portion of the hair remains as shown, and provides a thickened portion of the hair extension.

Figure 3C:
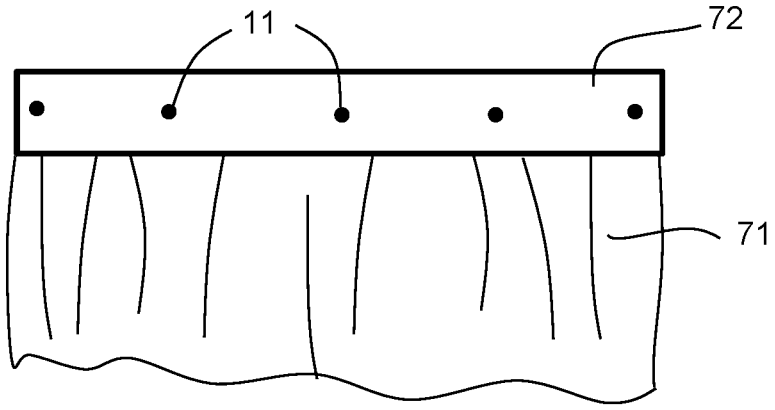
FIG. 3*c* is a front plan view of a hair weft including guide holes in accordance with some embodiments of the presently disclosed subject matter.

In some embodiments, the strip can include a series of guide holes 11 for guiding the attachment needle at a predetermined interval, as shown in FIG. 3*c*.

The weft can vary in thickness, length, and arrangement. For example, wefts with longer hair 71 can be applied near the back of a user's head, while wefts with shorter hairs can be applied near the crown of the head. It should also be appreciated that hair 71 can vary in color and texture (straight, wavy, curly, coiled) to blend with the user's natural hair.

Bottom weft 70 is thus positioned longitudinally just below seam 50 such that the weft abuts lower section 52 of natural hair 45. Thus, the weft is configured to abut the entire length of seam 50 to create a fluid transition between the weft and the user's natural hair.

Figure 4:
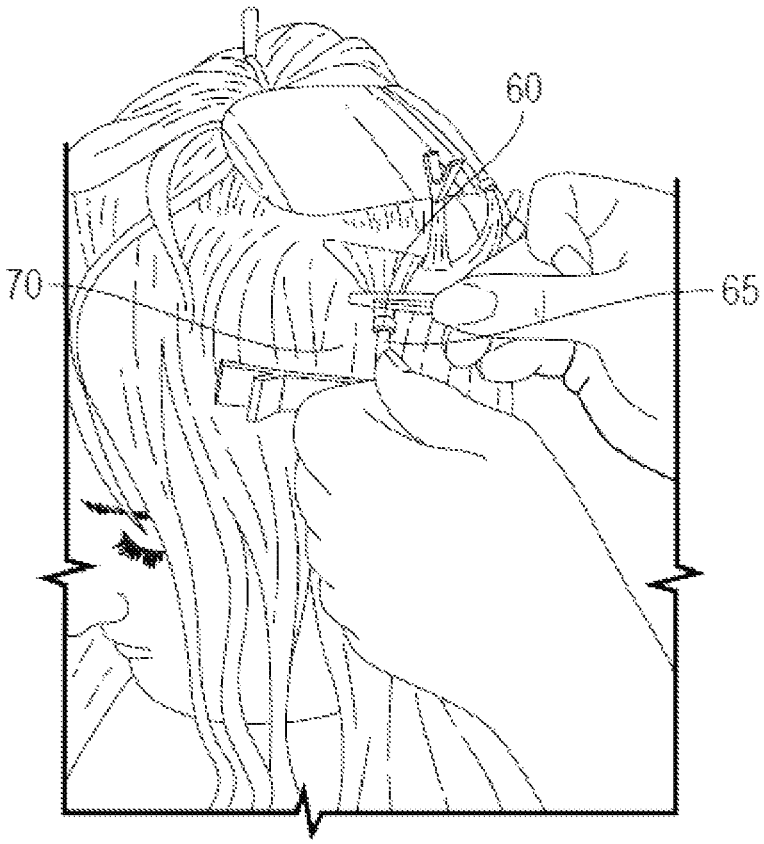
FIG. 4 is a front view of positioning beaded hair sections on top of the lower weft in accordance with some embodiments of the presently disclosed subject matter.

Beaded hair sections 65 are then laid on top of bottom weft 70 at step 20, as shown in FIG. 4. The beaded sections can be clipped or otherwise secured to bottom weft 50 using standard techniques, such as the use of barrettes, fasteners, and the like. Beads 60 therefore come into contact with bottom weft 70 instead of the user's scalp or natural hair.

Figure 5A:
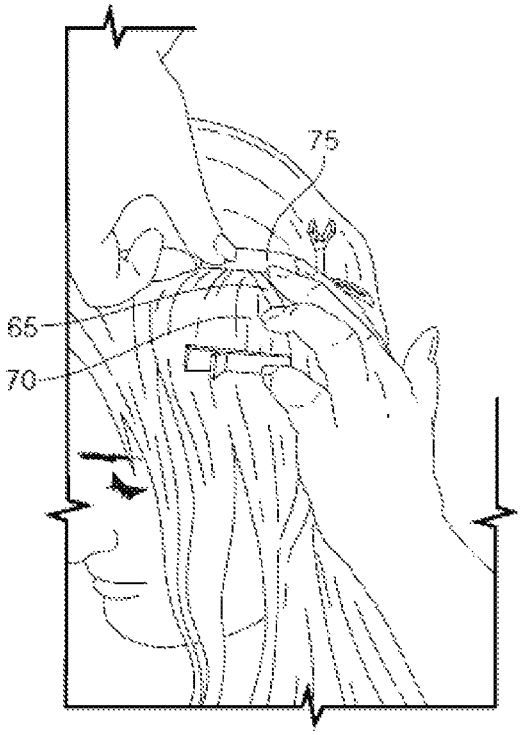
FIG. 5*a* is a front view of positioning an upper weft above the seam in accordance with some embodiments of the presently disclosed subject matter.
Figure 5B:
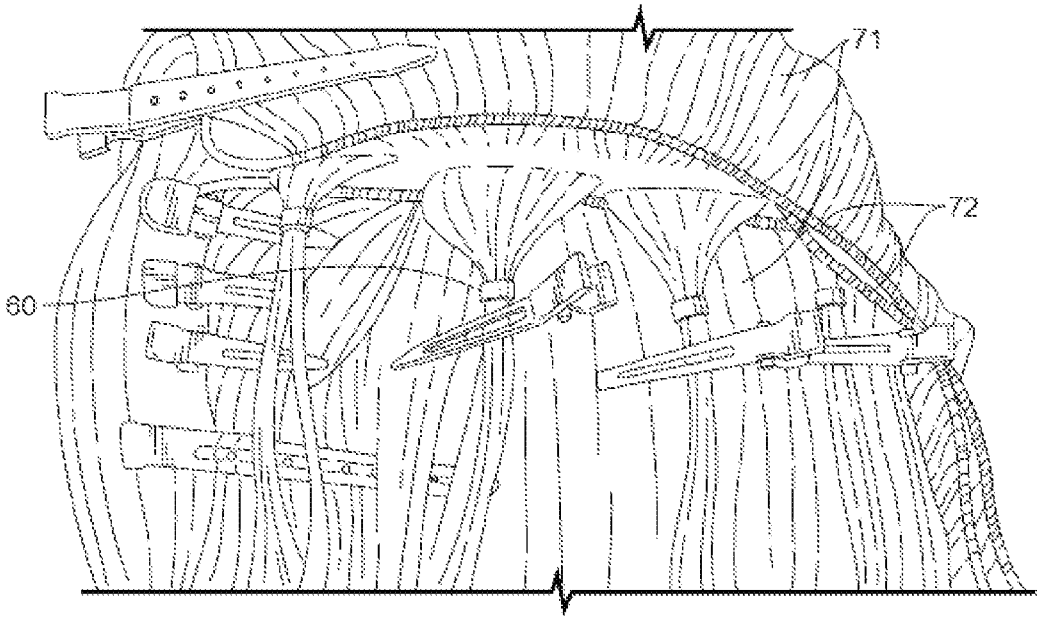
FIG. 5*b* is a front view of aligned and parallel upper and lower weft strips in accordance with some embodiments of the presently disclosed subject matter.

At step 25, hair extension top weft 75 is positioned above the bottom weft and seam, with beaded hair sections 65 in between the two wefts, as shown in FIGS. 5*a* and 5*b*. The top and bottom wefts 70, 75 are positioned such that they align with each other. Importantly, the top weft is positioned such that the top weft strip is parallel to and aligns with the strip of bottom weft 75. Hair 71 of the top weft is therefore positioned over the top of the user's head (i.e., the top weft is inverted relative to the bottom weft). In this way, the strips of the wefts are parallel with each other.

It should be appreciated that in some embodiments, a single top and/or bottom weft can be used. In other embodiments, any number of wefts can be used (e.g., 1, 2, 3 or more).

Figure 6A:
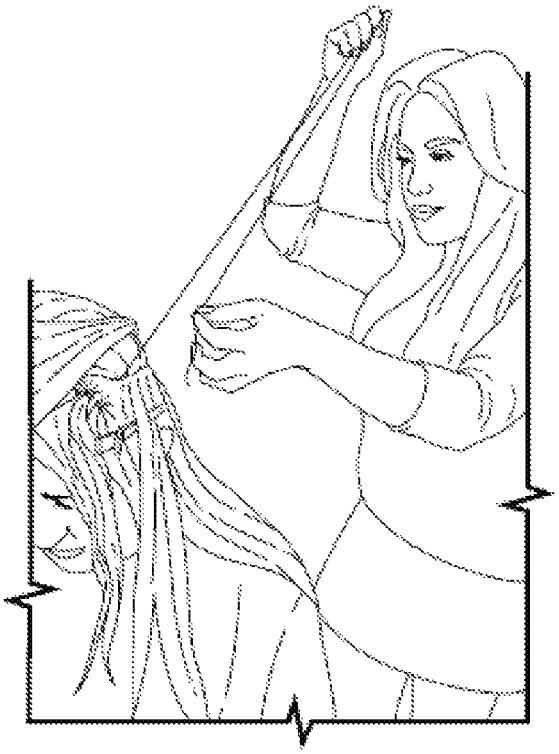
FIG. 6*a* is a front view of sewing the upper weft, lower weft, and beads in accordance with some embodiments of the presently disclosed subject matter.

The disclosed method further includes sewing through the top weft, bottom weft, and beaded hair at step 30, illustrated in FIG. 6*a*. Stated another way, the aligned weft strips of the top and bottom wefts are sewn together with the beads sewn in between to anchor the wefts in the user's natural hair. In some embodiments, the wefts are sewn together without sewing the beads in between.

Prior art methods of inserting hair extensions sew with the top extension weft directly overlayed with and on top of the bottom weft, which results in the thread being visible. This is unsightly and adds bulk to the extension.

Figure 6B:
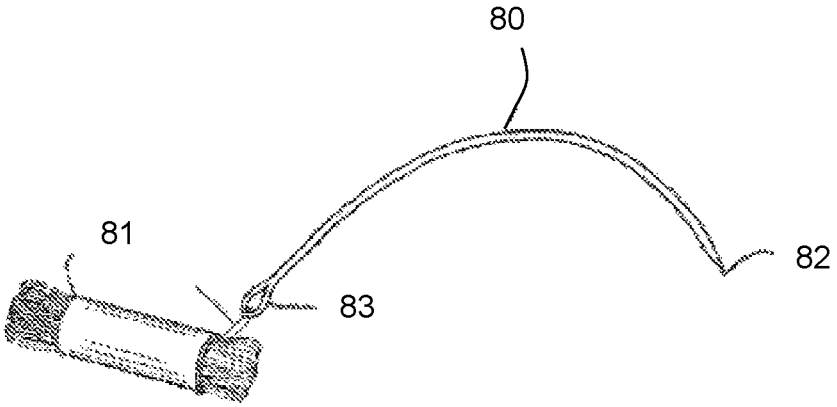
FIG. 6*b* is a font plan view of a needle and thread in accordance with some embodiments of the presently disclosed subject matter.

FIG. 6*b* illustrates one embodiment of needle 80 and thread 81 that can be used to secure the top and bottom wefts together with the beaded hair sections therebetween. As shown, the needle can be curved with sharp tip 82 and eyelet 83 that allows for the attachment of thread. It should be appreciated that any type of needle can be used. Similarly, any type of thread can be used, such as (but not limited to) polyester, cotton, nylon, polymeric material, and the like. In some embodiments, the thread can be thin (e.g., about 0.2, 0.15, 0.1, 0.5 mm) and strong (e.g., with a strength break of at least/no more than about 1, 2, 3, 4, 5, 6, 7, 8, 9, or 10 pounds). The term "strength break" refers to the amount of weight required to break the thread. In some embodiments, the thread strength is at least/no more than about 1000 denier.

In some embodiments, a single portion of thread can be used in the disclosed method. Thus, the single portion of thread can be used to sew from a first side to a second side of the weft strips. In other embodiments, the single portion of thread can be sewn from a first side to a second side of the wefts, and then back to the first side again (a double row of stitching).

Figure 6C:
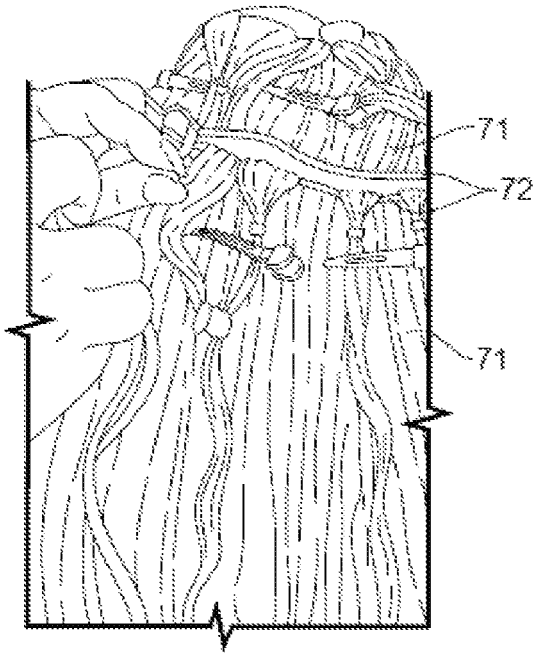
FIG. 6*c* is a front view of sewing the bottom weft, beads, and top weft in accordance with some embodiments of the presently disclosed subject matter.

FIG. 6*c* illustrates step 35 of the disclosed method, comprising sewing the weft strips and optionally beads, beginning from a first side to a second side of the beaded track. At the first side, the stylist can make an initial knot to anchor the thread. In some embodiments, the anchor knot can be reinforced with one or more additional stitches. The reinforcing stitches can further ensure that the weft strips lie flat against the user's scalp. Bead stitches can then be added through the bead. Specifically, the needle can pass through the top weft strip, pulling thread through the weft, the needle then passes through the bead opening. After the thread passes through the bead opening, the bead can be set in position using a tool (e.g., pliers). For example, a mechanical crimper can be used to collapse the periphery of bead 60, causing the bead to deform around the strand of hair running through the interior of the bead. The action therefore causes the bead to close tightly and is set in position.

The stylist can then sew through the bottom weft strip, repeating the process. The direction of sewing can then be reversed to secure the beads in position. It should also be appreciated that the wefts can be sewn in any direction (e.g., left to right, right to left, lower weft to upper weft, upper weft to lower weft). It is also important to note that during sewing the hair of the top weft remains flipped over (e.g., the top weft is inverted) such that the weft strips are parallel. The wefts are therefore not overlayed as with conventional methods.

After sewing, the wefts 70, 75 are cinched together by the sewing, with beaded sections 65 sandwiched in between. At this point, a new seam can be established, and the next set of hair extensions can be secured to the user's scalp. This can be repeated until the user has the desired number of hair extension wefts installed.

Figure 7A:
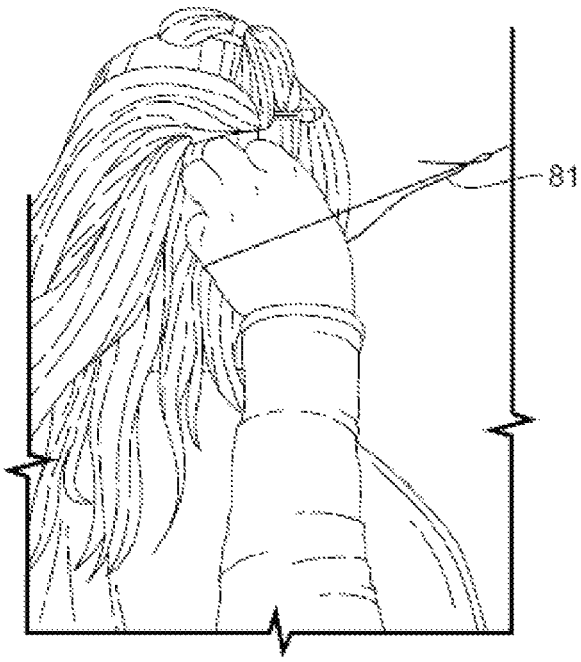
FIG. 7*a* is a front view of removing the clips after the wefts have been sewn in in accordance with some embodiments of the presently disclosed subject matter.
Figure 7B:
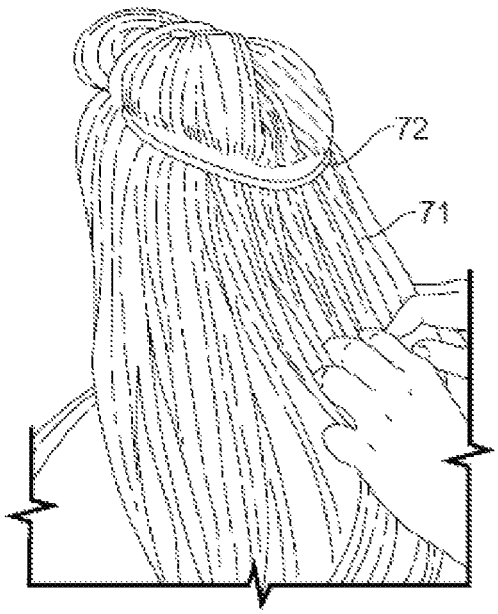
FIG. 7*b* is a front view of flipping the top weft down in accordance with some embodiments of the presently disclosed subject matter.
Figure 7C:
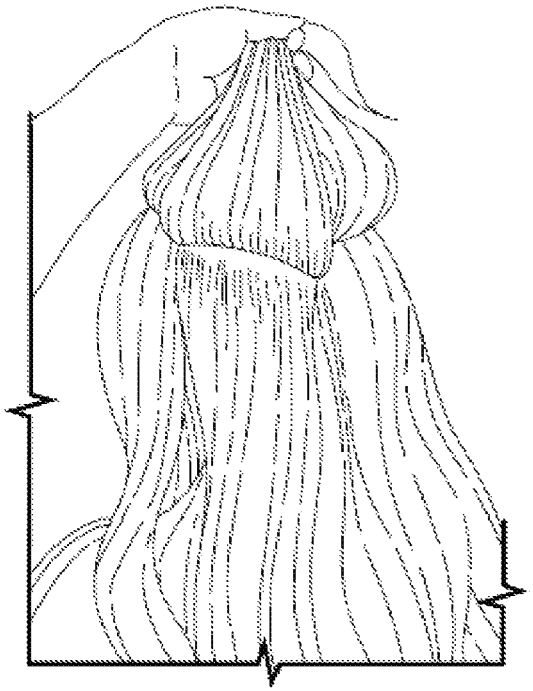
FIG. 7*c* is a front view of the installed wefts, with beads configured between the weft layers in accordance with some embodiments of the presently disclosed subject matter.

The hair from top extension 70 can then be flipped down and smoothed at step 40, shown in FIGS. 7*a* and 7*b*. Loose hair is pulled away, any clips are removed. Stated a different way, the top weft hair that was flipped over to allow the weft strips to align is then oriented in a downward direction (the use orientation). Advantageously, the user's hair overlays the wefts and the thread used to secure the wefts is seamless on the top and bottom because the wefts are sewn from the inside out, as shown in FIG. 7*c*. Stated another way, beads 60, thread 81, and the wefts are secured in between the top and bottom wefts without being visible. The wefts can remain in position for an extended period of time, such as about 4-8 weeks or more. The thread used to sew the wefts together is seamless because it is sewn from the inside out (the top weft being flipped after sewing to the use orientation). As such, the thread is not visible or is minimally visible. Thus, in some embodiments, the thread is invisible (not visible to an observer when viewing the extensions). Any thread that is minimally visible are vertical stitches (not horizontal stiches as with prior art methods) due to the inside-out sewing technique.

With traditional methods of applying weft hair extensions, the top weft is laid directly on top of the bottom weft, and the stylist will sew through the top weft, bottom weft, and bead. Undesirably, the bulky sewing method can lead to lumps and unnatural looking bumps at the site of the weft strips. In addition, the thread used to sew the wefts is visible.

To remove the wefts, a stylist can easily unclamp beads 60 to allow strands of the natural hair to be removed. The wefts can then simply be pulled from the scalp.

The disclosed method offers many advantages over prior methods of installing hair extensions. For example, method 5 is quick and efficient, allowing a stylist to move on to additional customers in an efficient manner.

For example, the disclosed method uses a seamless thread technique whereby the weft strips are sewn together using an inside-out technique. When the top weft is inverted after sewing, the thread is secured in between the wefts and is seamless (e.g., not visible or minimally visible).

The disclosed method is simple and requires no complicated devices to successfully perform.

Advantageously, beads 60 are covered by the upper and lower wefts, trapping the beads in between the weft layers and out of sight.

Method 5 is versatile, such that it can be used with any of a variety of beads, wefts, thread, and hair types.

The disclosed method is painless, avoiding pulling and tugging of the user's hair.

Method 5 is easy to use, allowing experienced professionals and new stylists both to use the method after a quick training period.

Because the top weft is inverted to allow the weft strips to align, the disclosed method produces seamless hair extensions that lack bulkiness of prior methods of installation. The beads and thread are essentially invisible to the observer.

The disclosed method minimizes stress on the user's natural hair, providing a quick installation (less than two hours), and maintenance process, as desired.

A single portion of thread can be used to sew the wefts together, as opposed to multiple strands of thread which is common with prior methods.

Exemplary embodiments of the methods and components of the presently disclosed subject matter have been described herein. As noted elsewhere, these embodiments have been described for illustrative purposes only, and are not limiting. Other embodiments are possible and are covered by the presently disclosed subject matter. Such embodiments will be apparent to persons skilled in the relevant art(s) based on the teachings contained herein. Thus, the breadth and scope of the present invention should not be limited by any of the above-described exemplary embodiments but should be defined only in accordance with the following claims and their equivalents.

What is claimed is:

1. A seamless threading method of attaching weft hair extensions to the natural hair of a user, the method comprising:

sectioning a bottom row from a top row via a seam in the natural hair of a user, wherein the seam is a desired location of attaching a hair extension;

creating a plurality of dropout sections between the bottom row and top row;

inserting each dropout section into a central channel of a corresponding bead to create a plurality of beaded drop out sections;

positioning a bottom weft hair extension below the seam and under the beaded dropout sections, wherein the bottom weft hair extension comprises a top strip and a plurality of hairs attached to the strip;

positioning a top weft hair extension above the seam and above the bottom weft in an inverted orientation, wherein the top weft hair extension comprises a top strip and a plurality of hairs attached to the strip, wherein the bottom weft strip and the top weft strip are aligned and parallel with each other, wherein the top weft hair extension in the inverted orientation is independently positioned relative to the bottom weft, and the beaded drop out sections are positioned between the bottom weft and the top weft;

sewing the strips of the bottom weft and top weft together with a needle and thread from an inside out orientation using vertical stitches, whereby the needle and thread pass through a portion of each weft strip, wherein the weft strips are sewn together from a first edge to a second edge and back to the first edge;

wherein the beads and thread are secured between the top weft and bottom weft;

inverting the top weft by positioning the top weft hair to overlay the bottom weft hair;

wherein the thread used to sew together the top and bottom wefts is seamless, being hidden from view by the top weft strip and hair; and wherein the vertical stitches are configured not to be snagged by a brush when brushing the hair.

2. The method of claim 1, further comprising repeating the method for a desired number of hair locations.

3. The method of claim 1, wherein the seam is horizontal or vertical.

4. The method of claim 1, wherein the seam is U-shaped, or V-shaped.

5. The method of claim 1, wherein each bead is selected from a clip, deformable cylinder, ring, or combinations thereof.

6. The method of claim 1, wherein each bead central channel comprises a silicone surface.

7. The method of claim 1, wherein each dropout section has a width of about 0.1-1 inch.

8. The method of claim 1, wherein the natural hair is damp or wet.

9. The method of claim 1, wherein the hair is selected from human hair, animal hair, artificial hair, or combinations thereof.

10. The method of claim 1, wherein the strip includes a plurality of guide holes sized and shaped for a needle to pass therethrough.

11. The method of claim 1, wherein the needle is a curved needle.

12. The method of claim 1, comprising about 5-20 beaded drop out sections.

13. The method of claim 1, wherein positioning a top weft hair in an inverted orientation comprises positioning the top weft hair in an inverted direction that does not overlay with the hair of the bottom weft.

14. The method of claim 1, wherein positioning a top weft hair in an inverted orientation comprises positioning the top weft hair to upwards over a top of the user's head.

15. The method of claim 1, further comprising adding another row of stitching to the top weft strip and bottom weft strips after inverting the top weft.

16. The method of claim 1, wherein a single portion of thread is used.

17. The method of claim 1, wherein the thread is polyester thread.

18. The method of claim 1, wherein the thread has a diameter of 0.2 mm or less.

19. The method of claim 1, wherein the thread strength is 1000 denier.

20. The method of claim 1, wherein the thread has a strength break of at least 5 pounds or more.

* * * * *